United States Patent [19]

Kishi

[11] 4,144,987

[45] Mar. 20, 1979

[54] LIQUID SPRAYER

[75] Inventor: Takao Kishi, Tokyo, Japan

[73] Assignee: Yoshino Kogyosho Co., Ltd., Tokyo, Japan

[21] Appl. No.: 813,051

[22] Filed: Jul. 5, 1977

Related U.S. Application Data

[63] Continuation of Ser. No. 692,522, Jun. 3, 1977, abandoned.

[30] Foreign Application Priority Data

Nov. 7, 1973 [JP] Japan ..... 48-125140

[51] Int. Cl.[2] ..... B05B 9/04

[52] U.S. Cl. ..... 222/321; 222/385; 239/333

[58] Field of Search ..... 222/383–385, 222/320, 321, 372, 382; 239/320–322, 331, 333

[56] References Cited

U.S. PATENT DOCUMENTS

| | | | |
|---|---|---|---|
| 3,331,559 | 7/1967 | Fedit | 222/321 |
| 3,746,260 | 7/1973 | Boris | 222/385 |

*Primary Examiner*—Robert J. Spar
*Assistant Examiner*—H. Grant Skaggs
*Attorney, Agent, or Firm*—Edwin E. Greigg

[57] ABSTRACT

A liquid sprayer having a cylinder with a pressure chamber and a suction chamber, a hollow piston with a liquid passage therethrough and slidably fitted in said cylinder, an actuator mounted on the piston, a suction tube suspended from the bottom of the suction chamber into a liquid container, a movable valve rod vertically movable provided in the piston and cylinder and having a valve portion at the top end thereof for opening and closing the liquid passage of the piston, a compression spring for at all times urging the movable valve rod towards the direction of lifting up the piston with the liquid passage thereof being closed, and an elastic valve closely and slidably fitted onto the valve rod and adapted to establish communication between the pressure chamber and the suction chamber at its uppermost position and cut off communication therebetween at its lowermost position; whereby the passage of the piston communicating with a spray nozzle is opened when the internal pressure of the pressure chamber exceeds a predetermined level.

4 Claims, 7 Drawing Figures

LIQUID SPRAYER

This is a continuation of application Ser. No. 692,522 filed June 3, 1977 and now abandoned.

BACKGROUND OF THE INVENTION

This invention relates to a relatively small liquid sprayer suitable for distributing and spraying the liquid contained in a container.

There are many conventional sprayers of this type. In all the conventional sprayers, the liquid sucked into a cylinder is sprayed by increasing the pressure inside the cylinder through the depressing operation of a piston and therefore the internal pressure of the cylinder varies with the depressing speed of the piston. As a result, the condition of atomized liquid affected by the internal pressure of the cylinder is inevitably varied with the depressing speed of the piston. Therefore, when the piston speed is high, a good quality spray is generated, but when it is low, atomization is not good. When piston speed is further lowered, the liquid is not atomized but is ejected in a solid non-atomized jet, without achieving the prime object of a sprayer. Even when the depressing speed of the piston is high, the internal pressure of the cylinder is lowered when spraying of the liquid sucked in the cylinder is nearly completed, and therefore the liquid is discharged in the form of a jet or droplets from the nozzle, resulting in deterioration of the liquid cut-out performance. This phenomenon will cause not only non-uniformity of the liquid sprayed, but also a poor or dirty appearance of a sprayed surface due to stains, etc.

This invention contemplates overcoming the aforementioned disadvantages of the conventional liquid sprayer, and to provide a novel and improved liquid sprayer.

OBJECTS OF THE INVENTION

It is, therefore, an object of the present invention to provide a liquid sprayer which can always generate a good quality spray irrespective of the speed at which the piston is depressed.

It is another object of the present invention to provide a liquid sprayer which can maintain the pressure in the cylinder at a predetermined level irrespective of the speed of travel of the piston.

It is still another object of the present invention to provide a liquid sprayer which can always generate a good quality spray irrespective of the speed of travel of the piston.

It is yet another object of the present invention to provide a liquid sprayer which can maintain the pressure in the cylinder at a predetermined level irrespective of the speed of travel of the piston.

It is a further object of the present invention to provide a liquid sprayer which has a good liquid cut-out performance and is high in reliability.

It is a still further object of the present invention to provide a liquid sprayer which can be used in any position.

These and other objects, features and advantages of the present invention will become more fully apparent from the following description taken in conjunction with the accompanying drawings, in which:

DESCRIPTION OF THE PREFERRED EMBODIMENTS

Figure 1:
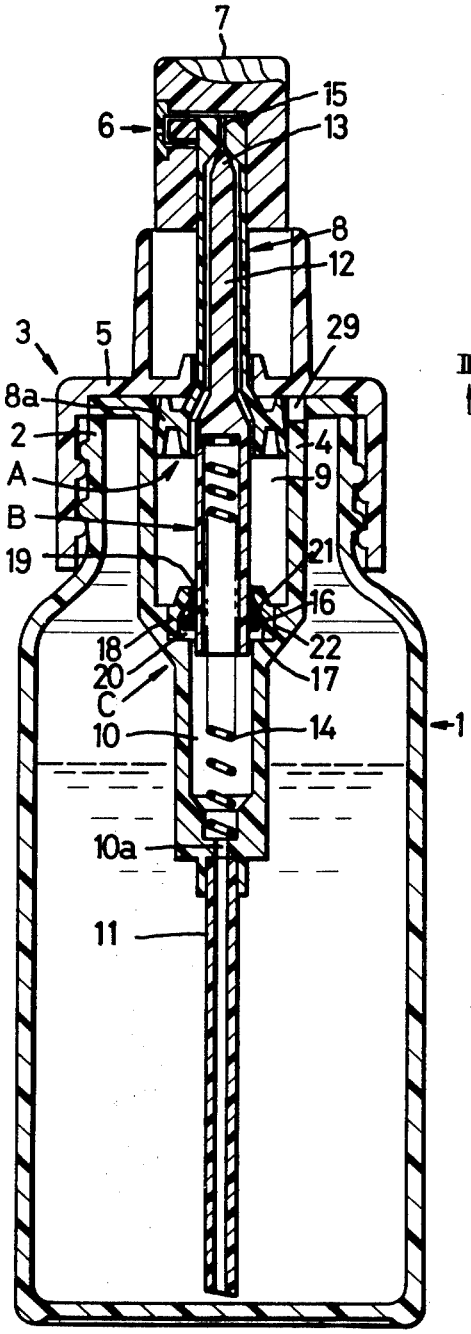
FIG. 1 is a vertical cross-sectional view illustrating a first embodiment of a liquid spraying device constructed in accordance with the teachings of the present invention.

Turning now to the drawings, a liquid container 1 has a neck 2 to which a support member 3 is removably connected by a force-fit or screw-fit. The support member 3 has a cylinder 4 suspended therefrom and an external cylinder 4' extending upwardly. It also has a hole **5*a* at the center of the top wall 5 thereof. An actuator in the form of a cap 7 having a spray nozzle 6 at one side thereof is adapted to fit in the external cylinder 4'. A reciprocal means in the form of a movable valve 8 fitted in the actuator in the form of a cap 7 at its one end is adapted to be slidable in the cylinder 4 through the hole 5*a* of the support member 3. Thus a pressure chamber 9, which is defined by the movable valve 8 and the cylinder 4, is formed in the cylinder 4**. In this manner, pressurized liquid spray means A is constituted.

The aforementioned movable valve 8 may be formed of synthetic resin integrally with a piston ring **8*a* or may be fitted in a piston ring separately formed of any other material. The bottom extension 10 of the cylinder 4, provides a suction chamber 10*a* for communication with the pressure chamber 9 and a suction tube 11 having a passageway 11*a* is associated with a passage 10*b*. The suction tube 11 is suspended from the passage 10*b* so that it may reach nearly to the bottom of the liquid container 1. In the pressure chamber 9, there is also provided a movable valve means in the form of an elongated rod 12 having an outer diameter smaller than the inner diameter of said movable valve 8 and having a valve element 13 at the top portion thereof. The lower portion of the valve rod extends into the suction chamber 10*a*. A compression spring 14 is disposed between the piston rod 12 and the bottom of the suction chamber 10*a* so that it may urge the movable valve rod 12 and the movable valve 8 upwardly to close a passage 15, all of which is clear from the view of FIG. 1**.

Figure 2:
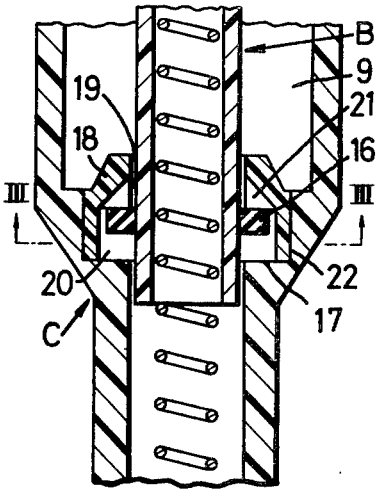
FIG. 2 is a fragmentary, enlarged vertical cross-sectional view of a limited portion of FIG. 1, with the discharge valve in closed condition.
Figure 3:
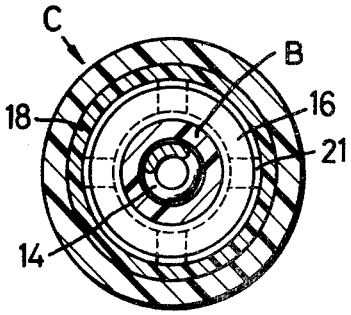
FIG. 3 is a view taken on the line III—III of FIG. 2.
Figure 4:
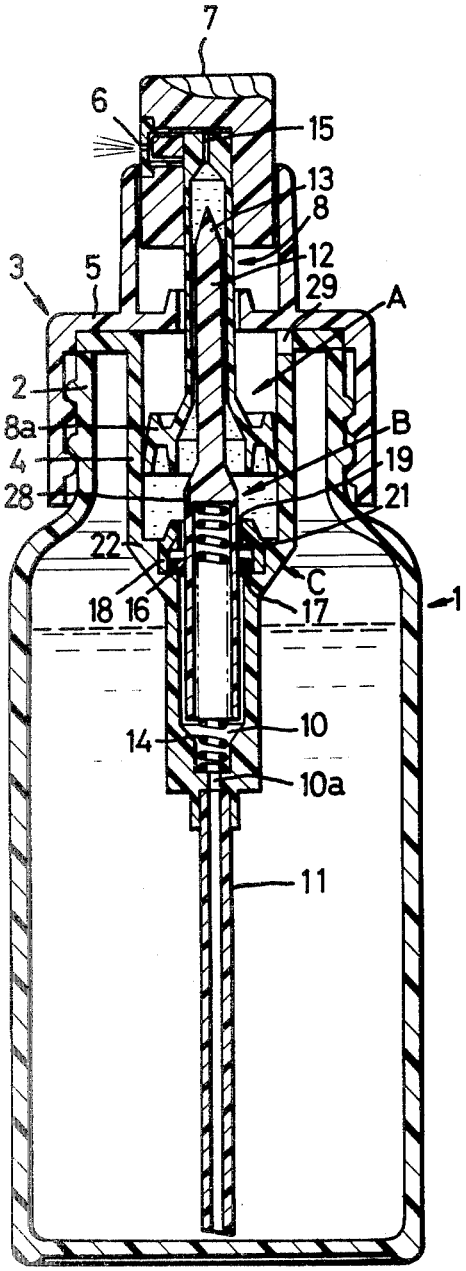
FIG. 4 is a vertical cross-sectional view generally similar to that of FIG. 1 but illustrating the device in operation.

The movable valve 8 and the movable valve rod 12 are disposed on the same axis so that they as a reciprocable means may be lowered by a piston-depressing-operation against the action of the compression spring 14 with the passage 15 of the movable valve 8 being closed. A ring-shaped elastic valve 16 (FIG. 2) is slidably fitted onto the movable valve rod 12. The elastic valve 16 is thus supported by the valve rod 12 so that it may reciprocate between an upwardly facing shoulder 17 (provided at the boundary portion 17*a* provided between the pressure chamber 9 and the suction chamber 10*a*) and a friction fitted annular control means 18 for said elastic valve means is seated in the aforementioned boundary portion. The control means 18 includes a perforation 19 through which the movable valve rod 12 is arranged to slide and, in addition, also provides a recess 20 between the upper portion thereof and the shoulder 17. A plurality of passages 21 (FIG. 3) are radially disposed on a downwardly facing shoulder portion of control means 18 and thereby provide for communication between the perforation 19 and the recess 20. The elastic valve 16 is thus moved upwardly and downwardly by the vertical movement of the valve rod 12 betwen the upwardly facing shoulder 17 and the downwardly facing shoulder of the recess 20. When the elastic valve 16 is moved downwardly to engage with the upwardly facing shoulder 17, a communication between the pressure chamber 9 and the suction chamber 10 is shut off. When the elastic valve 16 is moved upwardly, communication between the pressure chamber 9 and the suction chamber 10 is ensured through the passages 21. In this way, check valve means C is constituted as is best shown in greater detail in FIGS. 2 and 3.

Accordingly from the foregoing description, it will be observed that in the first embodiment shown in FIGS. 1 to 4, the movable valve 8 has a large-diameter portion into which the upper portion of the movable valve rod 12 is arranged to extend, and the compression spring 14 is disposed in the lower cavity in rod 12 between wall 12C and the bottom of suction chamber 10.

Figure 5:
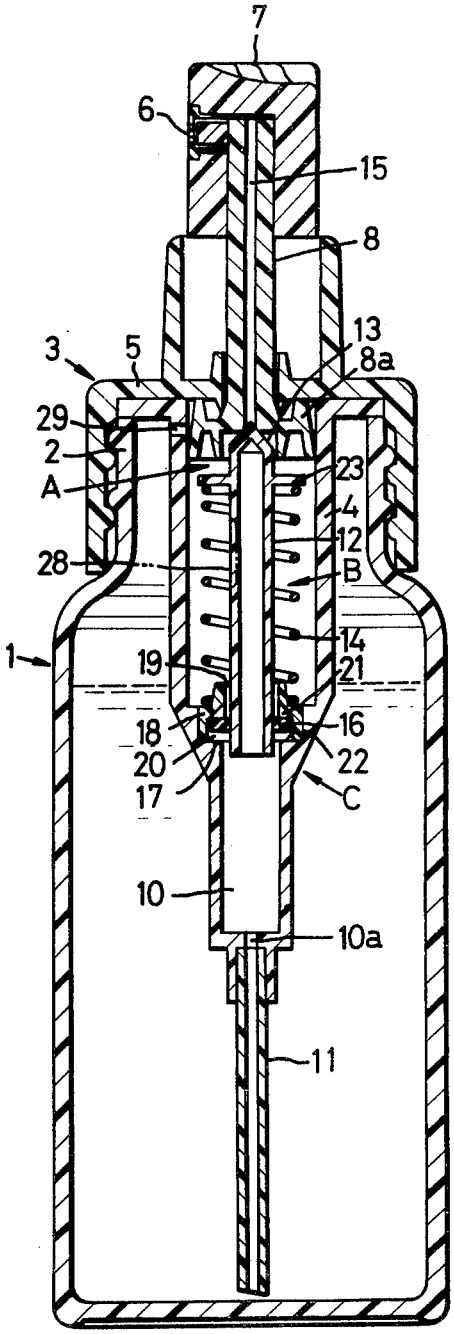
FIG. 5 is a vertical cross-sectional view of another embodiment of the present invention in an inoperative state.
Figure 6:
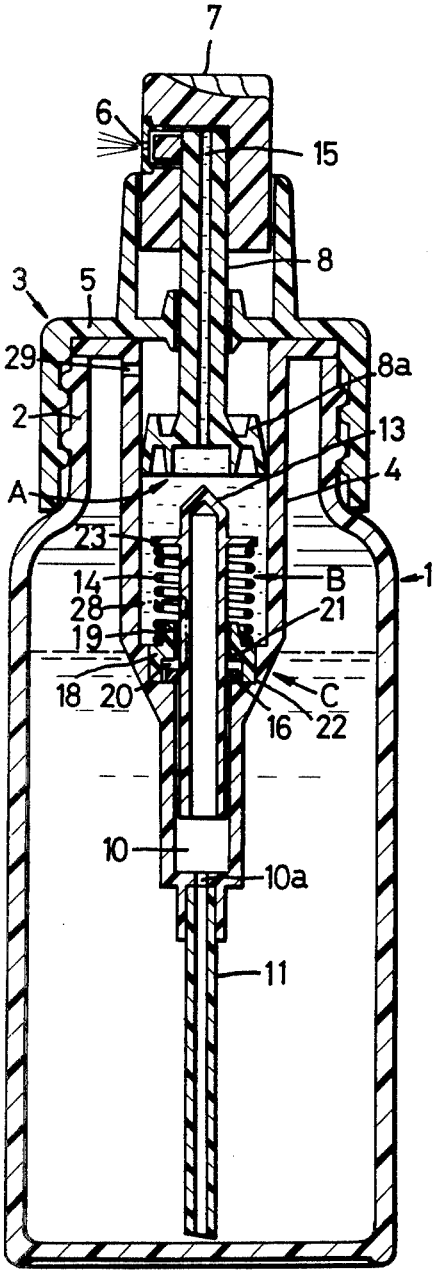
FIG. 6 is a vertical cross-sectional view of the embodiment of FIG. 5 showing the device in an operative state.

As distinguished therefrom, the second embodiment shown in FIGS. 5 and 6, shows the movable valve rod 12 is further provided adjacent to its upper portion with an annular flange 23 and the compression spring 14 surrounds the valve rod 12 and extends between the lower surface of the flange 23 and the control means 18.

Figure 7:
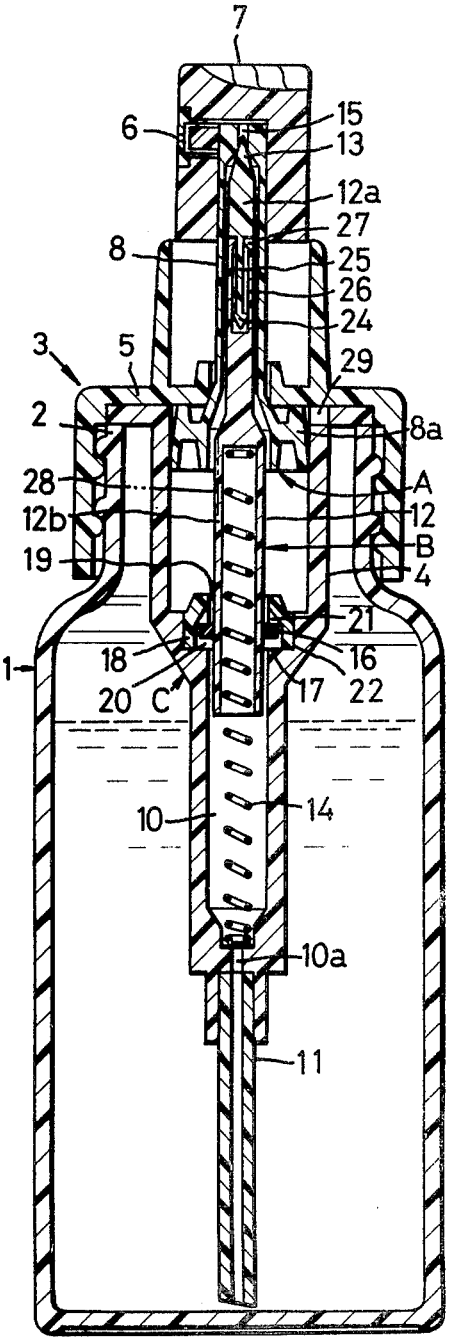
FIG. 7 is a further cross-sectional view of a third embodiment of the present invention in an inoperative state.

In the third embodiment shown in FIG. 7, the movable valve rod 12 is provided adjacent to its upper portion with an elongated aperture 26 into which is inserted an extension element 12*a* with the extension being retained in the aperture 26 by convergent fingers 27. The extension element 12*a* has a dependent guide rod 25 provided at its terminus with portion 24 and is retained in the aperture 26 by the convergent fingers 27. Of course, it will be understood that the guide rod may be formed on the lower member and the tubular portion may be formed on the upper member. Thus the movable valve rod 12 is adapted to expand and contract within a predetermined range. As will be described later in greater detail, when the movable valve rod 12 is lowered by the action of the inside pressure of the pressure chamber 9, the lower member 12*b* is first lowered thereby causing the enlarged portion 24 to contact convergent fingers 27 and then the upper member 12*a* is caused to move downwardly together with the lower member 12*b* to thereby open the passage 15 of the movable valve 8. In this way, the movable valve rod 12 is adapted to be operated in two stages and, in addition, can achieve the same function and effect as those of the first and second embodiments.

Throughout the views, the reference numeral 28 designates air grooves longitudinally provided on the peripheral wall of the movable valve rod 12. When the piston 8 is at its lowermost position in the initial stage of spraying operation, (See FIG. 6) the air grooves 28 lets the pressure chamber 9 communicate with the suction chamber 10 to exhaust the air contained in the pressure chamber 9 into the liquid container 1 thereby ensuring downward movement of the movable valve 8, and suction of liquid into the pressure chamber 9. The reference numeral 29 (FIGS. 4–7) designates an air inlet provided at one side of the upper portion of the peripheral wall of the cylinder 4. The air inlet 29 prevents reduction of the pressure in the liquid container 1 when the liquid in the container 1 is sprayed.

The operation of the liquid sprayer according to the present invention will now be described.

In FIGS. 1, 5 and 7, each of which shows the inoperative condition of each embodiment, the movable valve 8 is lifted up by the movable valve rod 12 by the action of the compression spring 14 to thereby close the passage 15, and the elastic valve 16 is also at its uppermost position with the result that no liquid is sucked into the pressure chamber 9.

If the movable valve 8 is depressed from the above-mentioned position, the movable valve rod 12 is lowered with the passage 15 of the movable valve 8 being closed and when the air grooves 28 reach the position where they can make communication between the pressure chamber 9 and the suction chamber 10*a*, the air contained in the pressure chamber 9 is exhausted into the liquid container 1. Thereafter, if the depressing force applied on the movable valve 8 is removed, the movable valve rod 12 and the movable valve 8 is moved upwardly, and the elastic valve 16 is also moved upwardly to abut against the downwardly facing shoulder 18 where it stops. In this state, liquid is sucked from the container 1 into the pressure chamber 9 through the suction tube 11, suction chamber 10 and the passages 21. Accordingly, if the movable valve 8 is again depressed, the movable valve rod is lowered in the same manner as mentioned above and, therefore, the elastic valve 16 abuts against the upwardly facing shoulder 17 to shut off communication between the pressure chamber 9 and the suction chamber 10. Thus the downward movement of the movable valve 8 results in increase of the internal pressure of the pressure chamber 9. When the internal pressure of the pressure chamber 9 is further increased in this manner to exceed the resilient force of the compression spring 14, the movable valve rod is lowered by the action of the internal pressure of the pressure chamber 9 and, therefore, the passage 15 of the movable valve 8 is opened to spray liquid through the nozzle 6 by the action of the internal pressure of the pressure chamber 9. As the spraying operation proceeds, the internal pressure of the pressure chamber 9 gradually decreases and, therefore, the movable valve rod 12 is lifted up to close the passage 15 thereby to suddenly stop the liquid spray.

As mentioned above, the movable valve rod 12, which opens and closes the passage 15, is provided with an elastic valve 16 slidably and closely fitted thereto and having an outer diameter smaller than the inner diameter of the cylinder 4. Therefore, the pressure chamber 9 can be pressurized by depressing the movable valve 8. In addition, it is not until the internal pressure of the pressure chamber 9 reaches a predetermined level that the movable valve rod 12 is lowered to open the passage 15 of the movable valve 8 thereby spraying liquid. Thus, liquid can be sprayed in the atomized state irrespective of the depressing speed of the movable valve 8. Moreover, since the decrease in the internal pressure of the pressure chamber 9 results in the upward movement of the movable valve rod 12 and thereby closes the passage 15 to stop spraying, the liquid spraying can be stopped in the atomized state without creating a solid non-atomized jet and the liquid cut-out performance is improved.

It will be understood from the foregoing description that the liquid sprayer according to the present invention can increase the internal pressure of the pressure chamber to a predetermined level irrespective of the piston depressing speed; can always obtain good atomized conditions of liquid for any kinds of piston depressing operations since the internal pressure of the pressure chamber, after it has reached a predetermined level, lowers the movable valve rod to open the passage of the movable valve; can eliminate the generation of a non-atomized jet of liquid since the movable valve rod closes the passage of the movable valve to stop spraying of liquid at its atomized state; can improve the liquid cut-out performance; can be used at any position including vertical, oblique and horizontal positions since the check valve means for establishing or cutting off communications between the pressure chamber and the suction chamber has an elastic valve closely fitted onto the movable valve rod and the passage of the movable valve is opened and closed directly by the movable valve rod as mentioned above.

What is claimed is:

1. A liquid spraying device comprising a container for liquid including pressure chamber means comprising a cylinder supported in the container;

piston means having a hollow portion arranged for reciprocation within said cylinder so that movement of said piston means in a downward direction pressurizes liquid in said pressure chamber means, actuator means mounted on the hollow portion of said piston means, said actuator having a nozzle, an opening in the hollow portion of the piston means, said nozzle communicating with said pressure chamber when said actuator is actuated;

first elongated valve means having a valve rod and tubular means extending below said valve rod, flange means carried by said valve means and arranged for reciprocation with said piston means to open said opening of said piston means by the action of the internal pressure of said pressure chamber, suction chamber means in communication with said pressure chamber means and containing said tubular means;

spring means cooperating with said first valve means to urge it in an upward direction so that said first elongated valve means closes said opening of said piston means; and second valve means between said pressure chamber and said suction chamber, said second valve means having a recess with a downwardly facing shoulder and a valve body located in said recess and slidable on said tubular means so as to control the connection between the pressure chamber and said suction chamber means so that the liquid is limited in its flow from said container to the pressure chamber during downward movement of said first valve means which moves said valve body to said downwardly facing shoulder, and maintaining said communication closed so long as said first valve means continues such downward movement.

2. A liquid spraying device as claimed in claim 1 in which the said spring means is interposed between said flange means carried by said first elongated valve means and a supporting portion in said second valve means.

3. A liquid spraying device as claimed in claim 1, in which said first elongated valve means includes at least one elongated groove and correlated with the longitudinal extent thereof to permit air to be expelled from said pressure chamber into said suction chamber upon downward movement of said piston means.

4. A liquid sprayer including a liquid container having a cylinder forming a pressure chamber;

a hollow piston with a liquid passage therethrough and slidably fitted in said pressure chamber so as to have an upstroke and a downstroke reciprocable movement therein;

an actuator having a spray nozzle mounted on said piston for moving said piston through its downstroke so as to pressurize any fluid in said pressure chamber;

a suction tube extending into said liquid container and in communication with said pressure chamber;

a valve rod movable with said piston and located in said pressure chamber and having a valve portion at one end thereof for opening and closing the liquid passage in said piston;

a compression spring urging said valve portion toward said piston for closing said liquid passage therein and for moving said piston through its upstroke;

means on said valve rod responsive to liquid pressure in said pressure chamber so as to open said liquid passage in said piston when the force exerted by said liquid pressure exceeds the force of said compression spring; and a second valve slidably fitted on said rod and located between said pressure chamber and said suction tube for establishing communication between the pressure chamber and said suction tube in one position and for cutting off communication therebetween in a second position, when liquid from said container is in said pressure chamber, said second valve being moved to its second position whenever and so long as the force on said valve rod exceeds that force of said compression spring so that said passage is closed when said piston is in its downstroke with liquid in said pressure chamber whereby said pressure chamber may be pressurized by said piston through its full downstroke.

* * * * *

UNITED STATES PATENT AND TRADEMARK OFFICE

CERTIFICATE OF CORRECTION

PATENT NO. : 4,144,987

DATED : March 20, 1979

INVENTOR(S) : Kishi

It is certified that error appears in the above-identified patent and that said Letters Patent is hereby corrected as shown below:

Title page:

In the Related U.S. Application Data, replace "1977" with --1976-- and after "abandoned" insert --, and a continuation of Ser. No. 521,188, Nov. 5, 1974, abandoned--.

In Col. 1, line 5, replace "1977" with --1976-- and after "abandoned" insert --, which was a continuation of Ser. No. 521,188, filed Nov. 5, 1974, now abandoned--.

Signed and Sealed this

Twenty-fifth Day of June, 1991

*Attest:*

*Attesting Officer*

HARRY F. MANBECK, JR.

*Commissioner of Patents and Trademarks*